United States Patent [19]

Codina

[11] 3,979,114

[45] Sept. 7, 1976

[54] PUSH-PULL TYPE EXERCISING DEVICE

[76] Inventor: Anthony E. Codina, 2337 Cypress Ave., Lemon Grove, Calif. 92045

[22] Filed: June 12, 1975

[21] Appl. No.: 586,185

[52] U.S. Cl. ..... 272/126; 272/900

[51] Int. Cl.[2] ..... A63B 21/00

[58] Field of Search ..... 272/79 R, 80, DIG. 4

[56] References Cited

UNITED STATES PATENTS

| | | | |
|---|---|---|---|
| 3,068,001 | 12/1962 | Portman | 272/79 R |
| 3,752,474 | 8/1973 | Macabet et al. | 272/79 R X |
| 3,858,874 | 1/1975 | Weider | 272/79 R |

*Primary Examiner*—Richard C. Pinkham
*Assistant Examiner*—William R. Browne
*Attorney, Agent, or Firm*—Bruno J. Verbeck

[57] ABSTRACT

An exercising device comprising two flexible lines, each line having a stirrup member at one end for receiving a person's foot therein and a loop member at the other end for grasping with a person's hand. The stirrup and loop members are each attached, by means of a slip-knot, onto the flexible lines between knots which are located at predetermined points on the lines. This permits a simple adjustability of the functional lengths of the lines to accommodate persons of different heights. Each of the lines passes over one of a pair of pulleys. A hanger line passes through a hollow tubular spacer and through openings located one at each end of the spacer and knots tied just above those openings. Each of the pulleys has a rotating eye through which the hanger lines passes as it leaves the ends of the spacer. A knot is tied above the said openings at the ends of the spacer thus anchoring each of the pulleys in place. The hanger line is also knotted with additional knots sufficiently distant from the spacer to permit placement of such additional knots on one side of a door top or jamb, so that in closing the door the additional knots remain on one side of the door and the spacer, along with the rest of the device, on the other.

4 Claims, 5 Drawing Figures

PUSH-PULL TYPE EXERCISING DEVICE

FIELD AND BACKGROUND OF THE INVENTION

Various body exercisers comprising flexible lines, pulleys and holding loops are known, such as those described, for example, in U.S. Pat. Nos. 1,144,085; 2,716,027; and 3,858,874. These prior art devices are not entirely satisfactory either because they are comparatively complicated, do not permit simple adjustability to accommodate persons of different height, or both.

BRIEF DESCRIPTION OF THE INVENTION

The present invention as described more fully hereinafter comprises a device, one end of which can be placed, e.g., over the top of a door, or passed through the jamb opening when the door is open, and the door then closed to solidly anchor that end of the device to the door. The said end of the device, in the form of a braided hanger line of nylon or the like, which has knots tied in it, can also be placed, e.g., over the doorknob and tied thereto. The hanger line passes through a hollow tubular spacer and through the swiveled eyes of pulleys, through openings in the wall of the spacer, and is knotted just above each of the said wall openings, thus separating the pulleys by the approximate length of the spacer. A flexible line passes over each of the pulleys. The lines are, preferably, each of them of a different or contrasting color to expedite separation of the lines, as when the device is being set up. Each of the lines has a foot or stirrup member and a hand grasping member.

When the device has been secured, e.g., to a door and is ready for use by a person wishing to carry out, e.g., one exercise in an upright position he grasps the loops or hand grasping members, one in each hand, steps into each of the stirrup members, and proceeds to pull alternately with each of the hand grasping members, thus simultaneously lifting one foot off the ground. If the functional lengths of the flexible lines are too long, the slip knots of the hand grasping members or the stirrup members are loosened, and the members moved up beyond one or more of the knots in the flexible lines.

There is a great variety of exercises that can be performed with the device, and some of these will be further described hereinafter.

DESCRIPTION OF A PREFERRED EMBODIMENT

Figure 1:
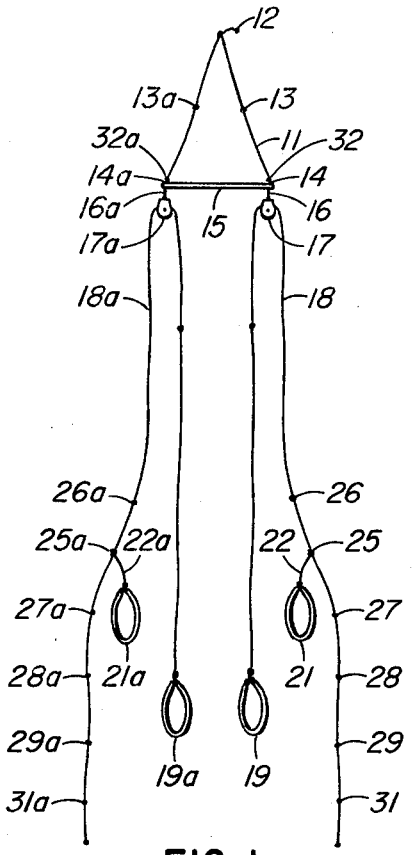
FIG. 1 is a plan view of the invention.
Figure 2:
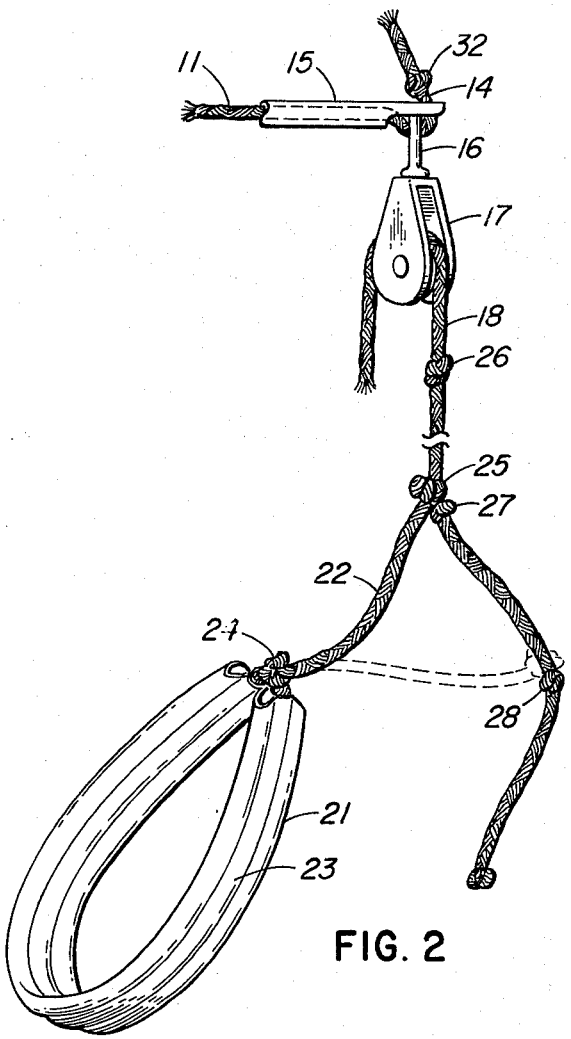
FIG. 2 is a perspective view of a part of device.

Referring now to the drawings, a hanging line 11, preferably of 3/16 inch hollow braided nylon, ethelene, or propylene, has ends which are knotted at **12, 32, 32*a* and also contains knots 13 and 13*a*. Before being knotted the line 11 is passed through an opening 14 in a hollow tubular spacer 15, which can be of 3/8 inch metal tubing, through the swivel eye 16, of pulley 17, into and through the spacer 15 and through a swivel eye 16*a* of a similar pulley 17*a* and through an opening 14*a* in the wall of spacer 15**.

Flexible lines 18 and **18*a*, conveniently of 3/16 inch hollow braided polyethylene, or the like, pass over pulleys 17 and 17*a* as shown. Stirrup members 19 and 19*a* are formed by passing one end of line 18 and 18*a* through a plastic sheath of a type which is in the form of three parallel, joined tubes, conventionally used as garden hose for "spray watering", and tying that end of the lines 18 and 18*a*** with a slip knot.

Hand-grasping, or loops, members 21 and **21*a* comprise, each of them, a length of braided hollow 3/16 inch nylon, polyethylene or propylene rope 22, passed through a plastic sheath 23 of the type above described in connection with the stirrup members 19 and 19*a*. The one end of rope 23 is tied onto itself with a slip knot 24, and the other end is attached to line 18 (and its opposite member 21*a* to line 18*a*) with a slip knot 25. Knots 26–31, and 26*a*–31*a* are put into lines 18*a* to permit adjustability of the functional lengths of lines 18 and 18*a*** to accommodate persons of different height using the device.

Figure 3:
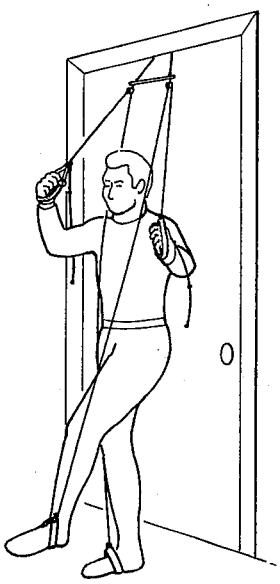
FIGS. 3, 4 and 5 are views showing representative exercises using my device.
Figure 4:
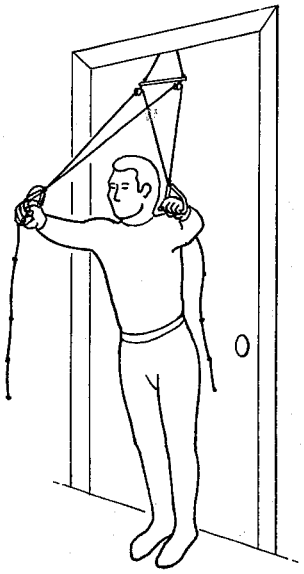
Figure 5:
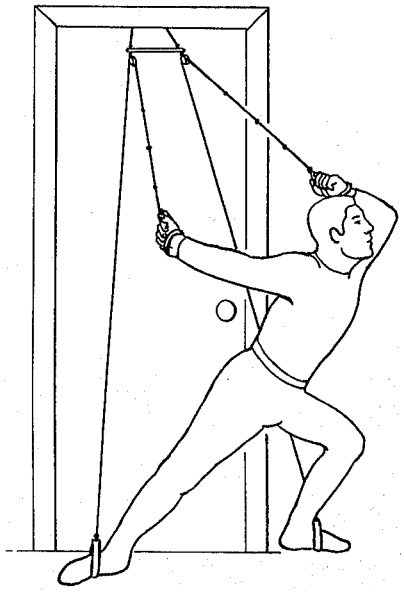

Uses of the device are illustrated in FIGS. 3, 4 and 5.

In FIG. 3, there is shown a method of performing a standing active and passive exercise with the extremities participating with epilateral extremity. This is an excellent procedure for increasing the range of motions of the hip joint.

FIG. 4 illustrates the performance of standing push-ups, exercising the upper extremities, shoulders and pectoral muscles. In this exercise the stirrup members are grasped in one hand and the hand-grasping members in the other hand and the arms and body moved appropriately.

FIG. 5 is illustrative of an active lower and upper extremity exercise with participation of the chest, abdomen and hips, carried out as shown by stretching arms and legs.

It will be understood of course that innumerable combinations and variations of the movements shown in the drawings are possible, the ones shown being merely illustrative of a few.

It will also be understood that while I have described a presently preferred embodiment of my invention in full detail, it will be obvious that my invention is not to be limited thereto or thereby, but only by that of the appended claims.

The invention claimed is:

1. A device of the character described comprising two flexible lines, each line having a stirrup member at one end for receiving a person's foot therein and a loop member at the other end for grasping by a person's hand; said loop members being knotted onto said flexible lines between knots located at predetermined points on said lines; a pair of pulleys, each receiving one of the said flexible lines; an elongated, hollow spacer having an opening at each end, said spacer supporting said pulleys; a hanger line for said spacer passing longitudinally through the length of said opening of said spacer, said hanger line being knotted adjacent to said spacer, to prevent movement of said spacer with respect to said hanger line; additional knots being spaced apart on said hanger line to permit placement of said last mentioned additional knots on one side of a doorjamb so that on closing of a door the said additional knots remain on one side of a door and the spacer on the other; each of said pulleys having a rotatable eye member through which passes said hanger line as it goes through said spacer and through said outer surface openings and maintains said pulleys near the ends of said spacer.

2. The device of claim 1 wherein said loop members are attached to said flexible lines by slip knots.

3. The device of claim 1 wherein each of said flexible lines is of a contrasting color.

4. The device of claim 1 wherein said hanger line is a hollow braided line.

* * * * *